US005698804A

United States Patent [19]

Mizuno

[11] Patent Number: 5,698,804

[45] Date of Patent: Dec. 16, 1997

[54] AUTOMATIC PERFORMANCE APPARATUS WITH ARRANGEMENT SELECTION SYSTEM

[75] Inventor: Shigehiko Mizuno, Shizuoka-ken, Japan

[73] Assignee: Yamaha Corporation, Hamamatsu, Japan

[21] Appl. No.: 599,559

[22] Filed: Feb. 15, 1996

[30] Foreign Application Priority Data

Feb. 15, 1995 [JP] Japan ..... 7-049277

[51] Int. Cl.[6] ..... G10H 1/36; G10H 7/00

[52] U.S. Cl. ..... 84/610; 84/615

[58] Field of Search ..... 84/609, 610, 615, 84/634, 653

[56] References Cited

U.S. PATENT DOCUMENTS

| | | | |
|---|---|---|---|
| 5,208,416 | 5/1993 | Hayakawa et al. | 84/634 |
| 5,457,282 | 10/1995 | Miyamoto et al. | 84/634 |
| 5,461,192 | 10/1995 | Imaizumi | 84/610 X |
| 5,481,066 | 1/1996 | Kitamura | 84/613 X |

FOREIGN PATENT DOCUMENTS 6186963 8/1994 Japan .

*Primary Examiner*—William M. Shoop, Jr.
*Assistant Examiner*—Jeffrey W. Donels
*Attorney, Agent, or Firm*—Loeb & Loeb LLP

[57] ABSTRACT

An automatic performance apparatus that realizes automatic performance with a variety of different arrangement patterns. The automatic performance apparatus uses automatic performance data that is formed from common data (for example, a main melody portion), and data of a plurality of arrangement styles. A user can select an arrangement style from the plurality of arrangement styles. By selecting an arrangement style, the common data representative of the main melody and data of the selected arrangement style are read out for the automatic performance. The automatic performance data includes identification data for identifying common data and the plurality of arrangement styles from each other. By using the identification data, common data and data for a selected arrangement are identified and selectively extracted so that the automatic performance is performed with a selected arrangement.

21 Claims, 13 Drawing Sheets

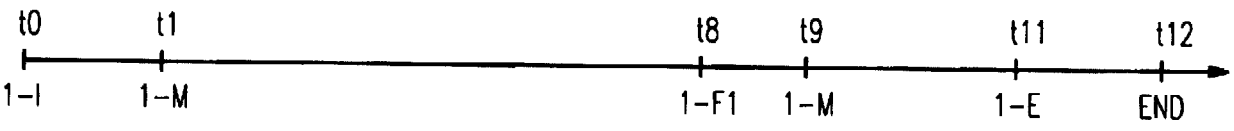
FIG. 12(A)
1ST ARRANGEMENT
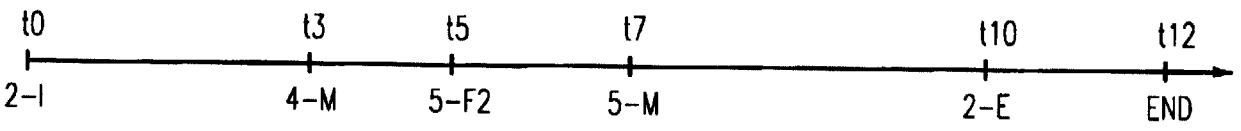
FIG. 12(B)
2ND ARRANGEMENT
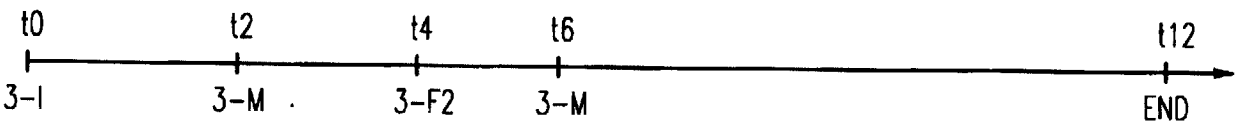
FIG. 12(C)
3RD ARRANGEMENT
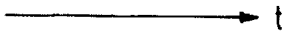
I: INTRODUCTION PATTERN M: MAIN PATTERN F1: 1ST FILL-IN PATTERN F2: 2ND FILL-IN PATTERN E: ENDING PATTERN

AUTOMATIC PERFORMANCE APPARATUS WITH ARRANGEMENT SELECTION SYSTEM

BACKGROUND OF THE INVENTION

1. Field of the Invention

The present invention relates to an automatic performance apparatus that performs an automatic performance based on stored automatic performance data.

2. Description of Related Art

An automatic performance apparatus is an apparatus in which automatic performance data of music, such as pitch data for each musical note, start timing data for sound generation / start timing data for sound muting, is stored in a memory, and the performance data is successively read out to generate musical notes at the time of automatic performance.

An event system is a known method for storing and reproducing performance data in an automatic performance apparatus. In the event system, musical note data composed of "event data and generation timing data for event data" is stored in the order of the progression of a musical piece.

There are several methods of storing event data representing a musical note in the event system. The storing methods are based on how event data is stored, and categorized in the following manner.

(1) A method of representing a musical note by two events of key-on and key-off, in which event data is formed from key-on data or key-off data for a specified key and note pitch data for that key.

(2) A method of representing a musical note by one event, in which event data includes key-on data for a specified key, note pitch data for that key and sound generation duration time data (or gate time data).

It is noted that event data not only includes key-on/key-off data, but also includes other event data such as tone color modification data, pitch bend data, tempo change data and the like.

In the conventional automatic performance apparatus, automatic performance data is read out from an internal memory media that stores the automatic performance data for at least one music piece. Alternatively, automatic performance data is read out from a memory media that is mounted on the automatic performance apparatus. The automatic performance is performed according to the read out automatic performance data.

Also, automatic performance data for one music piece is composed of automatic performance data for one arrangement. Therefore, in order to automatically perform the same music piece with different arrangements, the automatic performance apparatus has to store a plurality of automatic performance data having different arrangements. One of the automatic performance data with a designated arrangement is selected and read out from the plurality of automatic performance data to perform the, automatic performance. In other words, each automatic performance data has only one arrangement data. As a result, when a user selects a particular automatic performance with a particular arrangement, the selected automatic performance cannot be performed with a different arrangement. When the same music piece is desired to be automatically performed with different arrangements, the automatic performance data for each different arrangement .has to be individually stored. As a result, a large memory is required, music piece management is complicated and the amount of automatic performance data is increased.

SUMMARY OF THE INVENTION

It is an object of embodiments of the present invention to provide an automatic performance apparatus that has a memory media for storing automatic performance data with a plurality of arrangements .for one music piece. Automatic performance data of a selected arrangement is read out from the stored automatic performance data to perform the automatic performance. As a result, data for one music piece read out can be automatically performed with a plurality of different arrangements, and one file is used for storing automatic performance data. Therefore, data management of a music piece with a plurality of arrangements is easier as compared with the typical conventional systems in which automatic performance data is stored for each individual arrangement.

In accordance with an embodiment of the present invention, an automatic performance apparatus includes a plurality of unit automatic performance data formed from automatic performance data and different arrangement data, and a memory media having different memory regions. Each of the unit automatic performance data is stored in each of the different memory regions of the memory media, and the unit automatic performance data corresponding to a selected arrangement is selectively read out from one of the different memory regions to perform the automatic performance.

In accordance with another embodiment of the present invention, an automatic performance apparatus has a memory media designed to store automatic performance data of a plurality of arrangements in an intermixed state. Identification data is added to each of the automatic performance data to identify each of the plurality of arrangements contained within the automatic performance data, and a selected identification data is detected to extract automatic performance data corresponding to the selected arrangement from the memory media to perform the automatic performance.

In accordance with still another embodiment of the present invention, automatic performance data is formed from a plurality of channels, and an arrangement is determined in response to a selected channel.

In accordance with a further embodiment of the present invention, during an automatic performance, a currently selected arrangement is changeable to another arrangement by changing the currently selected identification data to different identification data or the currently selected channel to a different channel. When the arrangement is changed, the automatic performance data is continuously extracted to the automatic performance.

In one embodiment of the present invention, a memory media stores initial setting data for each of a plurality of arrangements, and a performance environment is set based on the initial setting data corresponding to a selected arrangement.

In another embodiment of the present invention, a part of the automatic performance data defines common data that is used for a plurality of arrangements. Since automatic performance data is commonly used for different arrangements, the amount of automatic performance data is substantially reduced. Further, an arrangement can be easily or readily changed during the automatic performance. For example, the automatic performance of a rock 'n roll style music piece may be changed to a pops style music piece. Accordingly, the automatic performance may be performed with a variety of musical patterns.

In an automatic performance apparatus in accordance with still another embodiment of the present invention, music data includes automatic performance data, a plurality of accompaniment pattern data, a corresponding plurality of accompaniment selection data for selecting the accompaniment pattern data, and a plurality of arrangement data. An automatic performance is performed based on the automatic performance data, and the accompaniment pattern data is selected based on the accompaniment selection data which corresponds to a selected arrangement so that the automatic accompaniment is performed based on the selected accompaniment pattern data.

Other features and advantages of the invention will be apparent from the following detailed description, taken in conjunction with the accompanying drawings which illustrate, by way of example, various features of embodiments of the invention.

BRIEF DESCRIPTION OF THE DRAWINGS

A detailed description of embodiments of the invention will be made with reference to the accompanying drawings.

FIG. 7 (B) shows a second half of the flow chart of a first reproducing process using the first data format embodiment.

FIGS. 12 (A), 12 (B) and 12 (C) illustrate accompaniment patterns for different arrangements using the fourth data format embodiment.

DETAILED DESCRIPTION OF EMBODIMENTS

Figure 1:
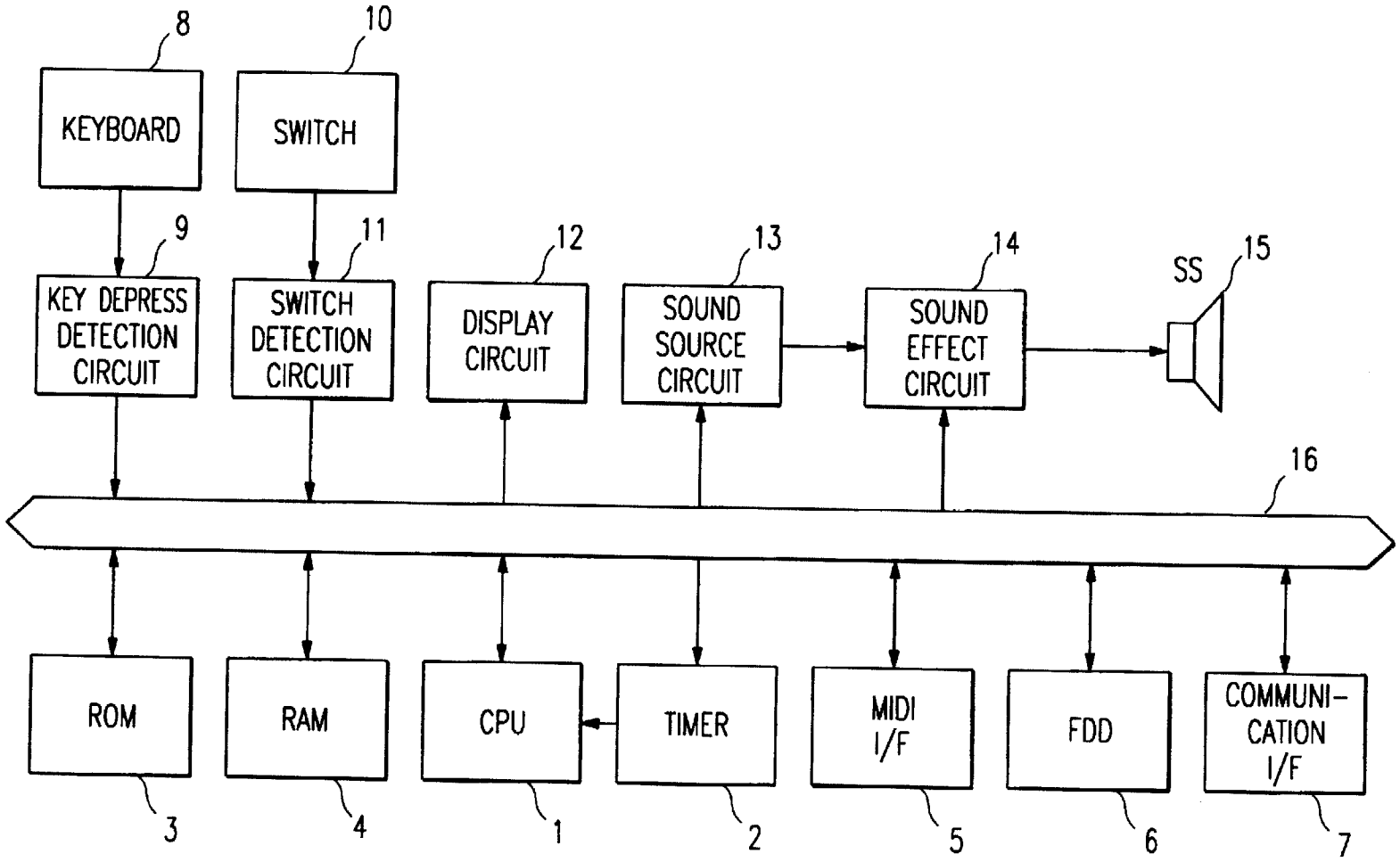
FIG. 1 shows a block diagram of an automatic performance apparatus in accordance with an embodiment of the present invention.

FIG. 1 shows a block diagram of an automatic performance apparatus in accordance with an embodiment of the present invention.

As shown in FIG. 1, a CPU (microprocessor) 1 is connected to a bus line 16, and controls a variety of units coupled to the bus line 16 based on a CPU program stored in a ROM (read only memory) 3 or the like. During automatic performance, automatic performance data is transferred and stored in a RAM (random access memory) 4 or the like. Automatic performance data includes, for example, key-on data, tone color data and the like, which will be described in detail below. The CPU 1 reads the automatic performance data from the RAM 4, and transfers the key-on data, tone color data and the like, to a sound source circuit 13, via the bus line 16, to generate musical note waveforms. The musical note waveforms are supplied to a musical effect circuit 14 by which various musical effects such as reverberation, and the like, are added, and outputted through a sound system 15.

Operation of a switch 10 is detected by a switch detection circuit 11, and a detection signal is sent from the switch detection circuit 11 via the bus 16 to the CPU 1. In one embodiment, the switch 10 is formed from a toggle switch. The switch 10 may be formed from a group of switch devices, and is provided to perform a switching on and off of the automatic performance, and selection of an automatic performance and an arrangement. In this case, the switching on and off of the automatic performance and the selection of the automatic performance and an arrangement may be carried out while a user is viewing a display on a display circuit 12. The automatic performance data in this embodiment is stored in the RAM 4. However, in alternative embodiments, the automatic performance data may be read out from a floppy disc by a floppy disc drive 6 or the automatic performance data may be transferred from an external source through a MIDI interface 5 or a communication interface (I/F) 7.

A keyboard 8 may also be provided to allow not only automatic performance of a music, but also a manual performance of a music. Moreover, real time performance data from the keyboard 8 may be stored in the RAM 4 for later automatic performance. In one embodiment, events of the keyboard 8 are detected by a key depression detection circuit 9. Also, the keyboard may be used to accompany the automatic performance.

The RAM 4 is also used as a working memory for the CPU 1 and temporarily stores various computation results and various data. A timer 2 generates interruption signals at a timing that designates a specified performance timing during the automatic performance, to cause the CPU I to perform a reproduction process.

Figure 2:
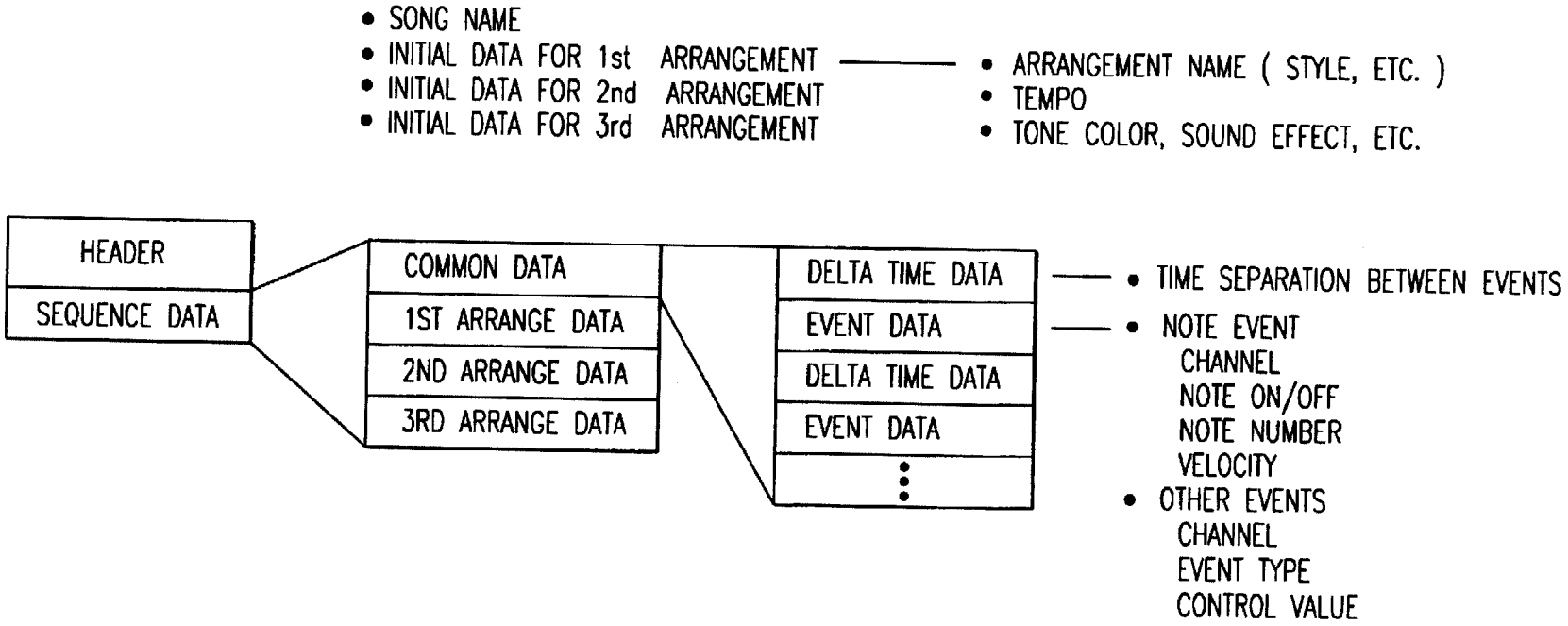
FIG. 2 shows a first data format in accordance with a first embodiment of the present invention.
Figure 3:
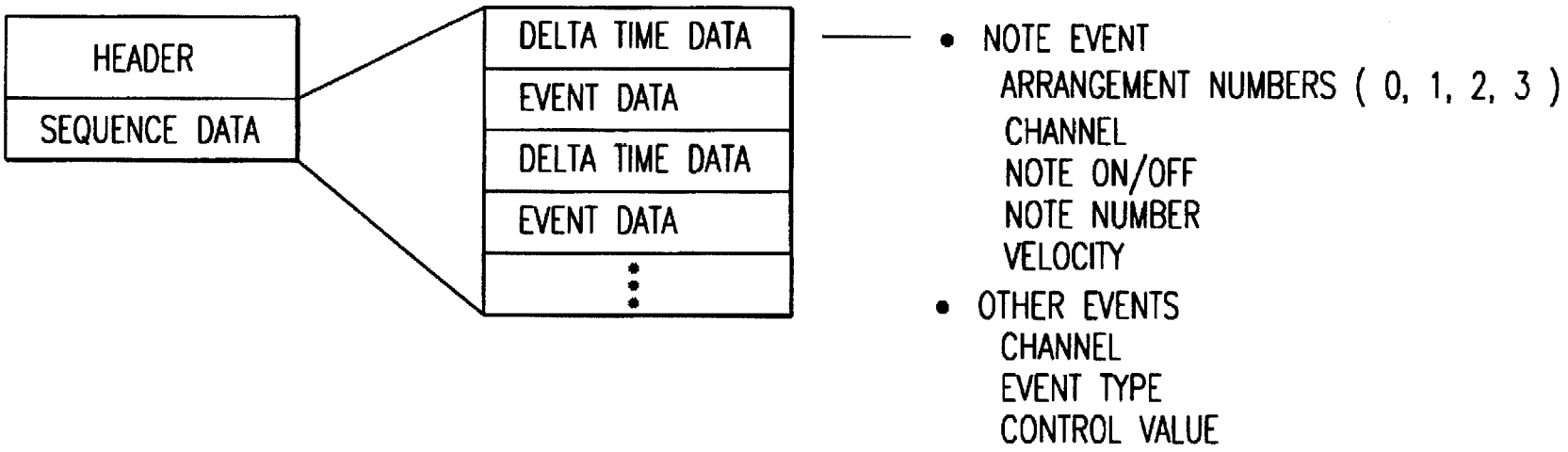
FIG. 3 shows a second data format in accordance with a second embodiment of the present invention.
Figure 4:
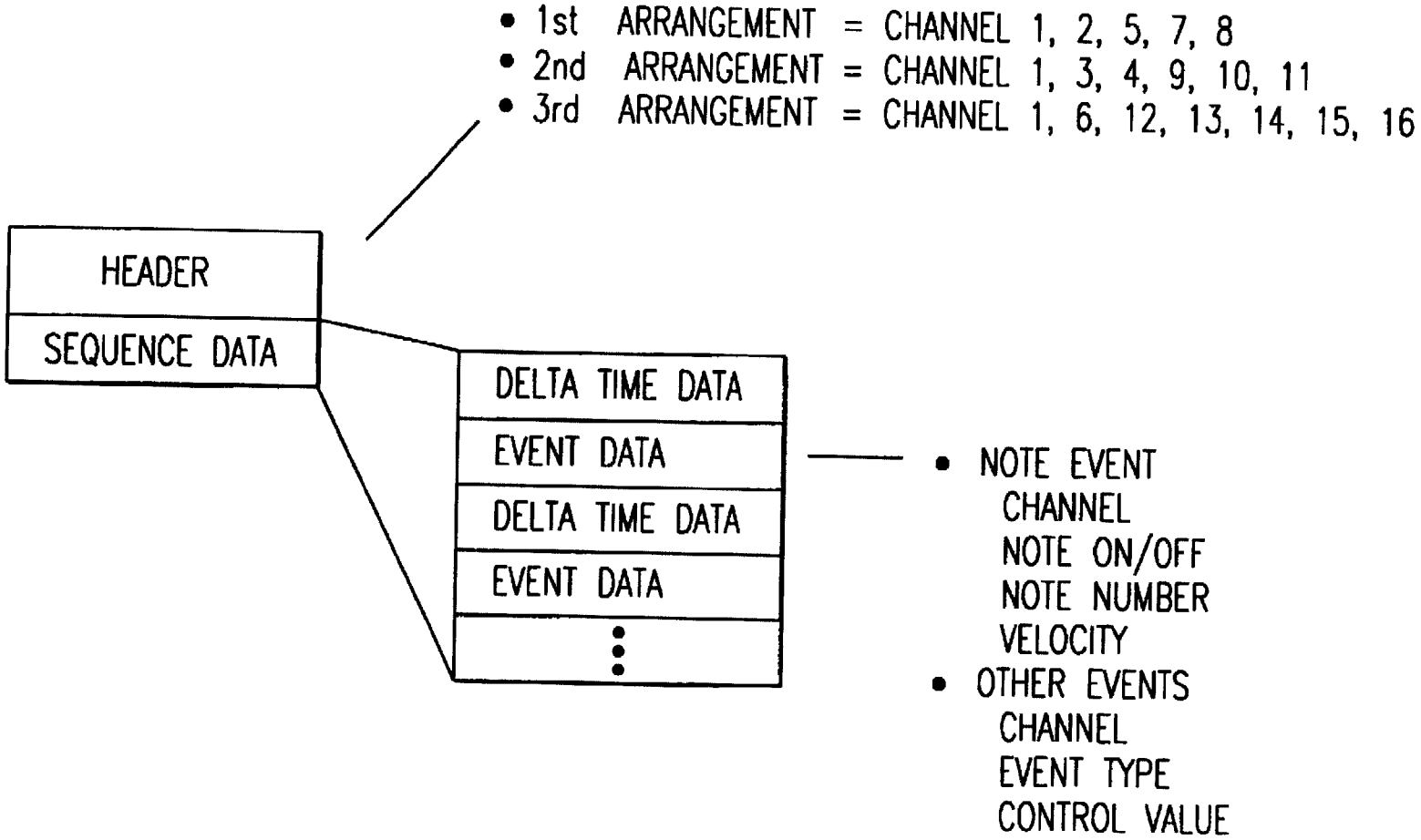
FIG. 4 shows a data format in accordance with a third embodiment of the present invention.

FIGS. 2–4 show data formats of automatic performance data to be stored in a memory media in accordance with embodiments of the present invention.

In a data format in accordance with a first embodiment shown in FIG. 2, the automatic performance data is formed from a header portion and a sequence data portion. The header portion includes song name data, initial data for a first arrangement, initial data for a second arrangement and initial data for a third arrangement. Data for each arrangement includes data representing an arrangement name for a music style (e.g., rock 'n roll style, classical style and the like), data of a tempo appropriate to the specified arrangement, data of tone color and musical effects appropriate to the specified arrangement.

The sequence data portion includes common data commonly used for all of the arrangements, and independent data such as arrangement data for the first arrangement, arrangement data for the second arrangement and arrangement data for the third or more arrangement which are all stored independently from each other. The independent data may be stored in different memory regions in the memory media. The common data is formed from event data representing various events and delta time; data that indicates a lapse of time between the various events. Event data includes note event data and other event data. Note event data includes, for example, channel number data, note-on/note-off data, note number data, velocity data and the like, and other event data includes, for example, event type data and control data that is determined by the event type. Event type data includes, for example, channel number data, loudness data, pitch bend data and pedal data Typically, the sequence data is arranged such that the plural parts with a plurality of different tone colors may be simultaneously played as the automatic performance. In an embodiment, the sequence data includes a plurality of performance data corresponding to the plural parts that are played in parallel with each other as the automatic performance. The plurality of performance data may be stored in an intermixed state in a single Storage region, or may be stored in the corresponding number of separate storage regions. A tone color for each part is designated by data in the header portion, and the plural parts with the plurality of different tone colors are respectively defined by channel numbers. The channel numbers correspond to the respective MIDI channel numbers of a sound source.

Each of data for the first arrangement, the second arrangement and the third arrangement has a data structure similar to that of the common data.

When a desired arrangement is selected by the switch 10 (see FIG. 1 ), the arrangement data representative of the selected arrangement is read out from a corresponding memory region, and the common data is also read out from a memory region that stores the common data (hereinafter referred to as a common data memory region) to carry out the automatic performance.

For example, a melody pad is commonly generated based on the common data for all of the arrangements, and the other pads of the performance are generated with different automatic performance data for each arrangement. Alternatively, where a plurality of pads other that a melody pad are provided, one of the pads or a plurality of pads among the pads may be commonly generated for all the arrangements. For example, where the sequence data includes data for five different pads, such as for example, a melody pad, a drum pad, a base pad, a first chord pad (e.g., by piano) and a second chord pad (e.g., by guitar), the dram pad and the base pad are commonly generated based on the common data for all of the arrangements, and the melody part, the first chord pad and the second chord pad are generated with different automatic performance data for each arrangement.

It is noted that arrangements can each have different content, tone color, and even a different tempo. Furthermore, an arrangement can be formed such that the number of parts changes in accordance with a specified arrangement.

A variety of memory medias are used to store the automatic performance data, such as for example, a ROM (read only memory), a RAM (random access memory), a hard disc, a floppy disc, a photo disc and the like. Furthermore, the data formats are applicable not only to data that is stored, but also to data that is transmitted through public lines and a through communication I/F 7.

Next, a data format in accordance with a second embodiment of the present invention is shown in FIG. 3. The data format of the second embodiment is different from the first embodiment in that sequence data is formed from common data, data for a first arrangement, a second arrangement and a third arrangement that are all intermixed with each other.

Namely, the sequence data shown in FIG. 3 is formed from delta time data and event data that are alternately arranged with each other. To distinguish the intermixed data from each other, the data (e.g., note event data and other event data that form each event data) includes arrangement numbers (0, 1, 2, 3). It is noted that more arrangement numbers are used for more arrangements. For example, five different arrangement number may be used for five arrangements.

The arrangement number "0" is an identification number for identifying common data, the arrangement numbers "1", "2" and "3" are identification numbers for identifying the different arrangements types. To automatically perform a music piece with a selected arrangement, common data and data only required for the selected arrangement are extracted from all of the sequence data read out by detecting an arrangement number that corresponds to the common data and the particular selected arrangement.

Other aspects of this data format are the same as those of the first embodiment, and therefore the description therefor is omitted.

FIG. 4 shows a data format in accordance with a third embodiment of the present invention. The data format of the third embodiment is formed from common data, data for a first arrangement, a second arrangement and a third arrangement that are intermixed with each other in a manner that is similar to the second embodiment. However, the third data format embodiment does not use special data, such as the arrangement numbers used in the second embodiment. Instead, data is identified by channel numbers. As a result, the automatic performance is realized by using a standard MIDI file. It is noted that the automatic performance data in the data format of the first embodiment can also be realized by using a standard MIDI file.

Accordingly, in the third embodiment data format, common data and data required for a selected arrangement are extracted from all of the read out sequence data by detecting channel numbers to carry out the automatic performance with the selected arrangement.

In one embodiment, sixteen (16) channels are provided to designate three different arrangements. For example, the first arrangement is represented by channels 1, 2, 5, 7 and 8, the second arrangement is represented by channels 1, 3, 4, 9, 10 and 11, and the third arrangement is represented by channels 1, 6, 12, 13, 14, 15 and 16. In this case, the common data is stored as channel 1.

Other aspects of the data format are the same as those of the first embodiment, and therefore the detailed description thereof is omitted.

Next, an operation of an automatic performance apparatus in accordance with embodiments of the present invention is described in detail with reference to the accompanying flow charts.

Figure 5:
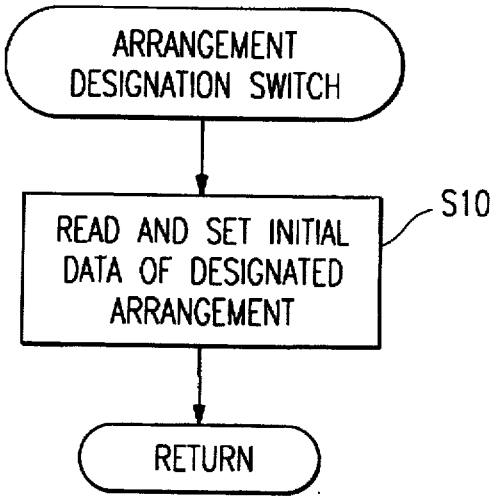
FIG. 5 shows a flow chart of an arrangement designation switching process.

FIG. 5 is a flow chart of a switching process for designating an arrangement that is executed upon operating the arrangement setting switch 10 when a song is selected. In one embodiment, the switch 10 is formed from a toggle switch that alternately switches between start condition and stop condition. When the switch 10 is operated, initial data of a designated arrangement stored in a header portion of the automatic performance data is read out and set in step $10, and the process then returns to a main routine. As a result, tone color data is set for the sound source circuit 13, tempo data for controlling the timer cycle is set for the timer 2, and sound effect data is set for the sound effect circuit 14, by which preparation for the automatic performance is completed.

In this case, identification titles of arrangements stored in the header portion may be initially read out and displayed in the display circuit 12 to allow a user to select an arrangement with the switch 10 from the displayed arrangement identification titles.

Figure 6:
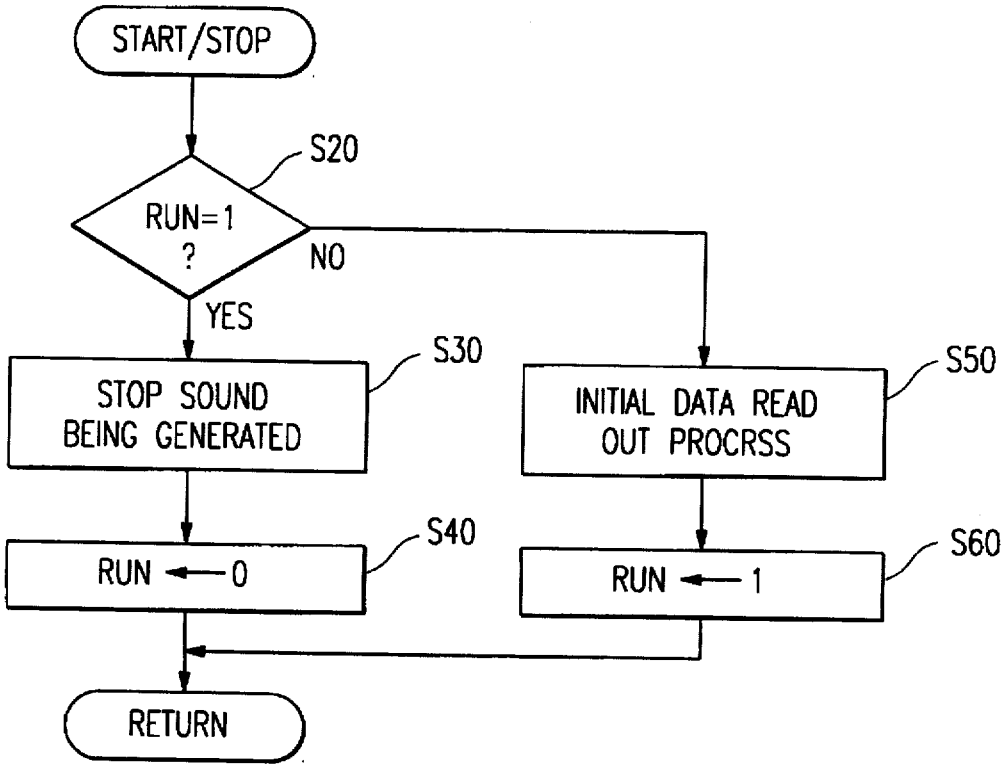
FIG. 6 shows a flow chart of a start/stop process.

Next, FIG. 6 shows a flow chart of a start/stop process for the automatic performance. The start/stop operation is carried out by operating the switch 10. In step S20, a determination is made as to whether a RUN flag is set at "1". If the determination indicates that the RUN flag is "1" (meaning that the switch 10 is depressed by the user to designate the stop process during the automatic performance), a musical note being generated is stopped in step S30, the RUN flag is set to "0" in step S40, and the process returns to the main routine.

If the determination is "RUN≠1" (meaning that the RUN flag is "0"), automatic performance is started, the process proceeds to step S50. In step S50, an initial data read process is performed. As a result, the first delta time data is read out and set in a register (TIME) (not shown) that measures a time lapse. Then, the RUN flag is set to "1", and the process returns to the main routine.

Figure 7A:
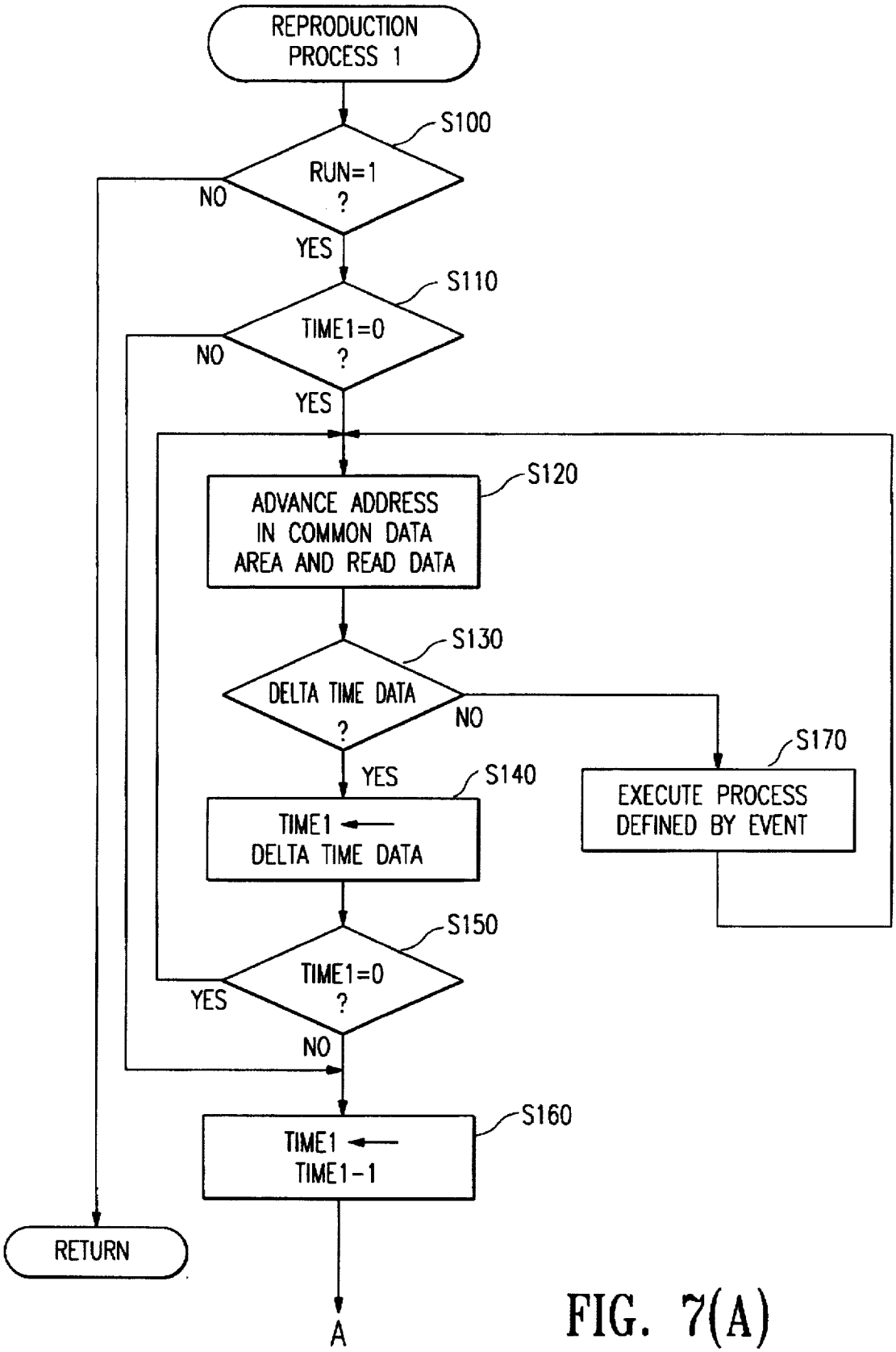
FIG. 7 (A) shows a first half of a flow chart of a first reproducing process using the first data format embodiment.
Figure 7B:
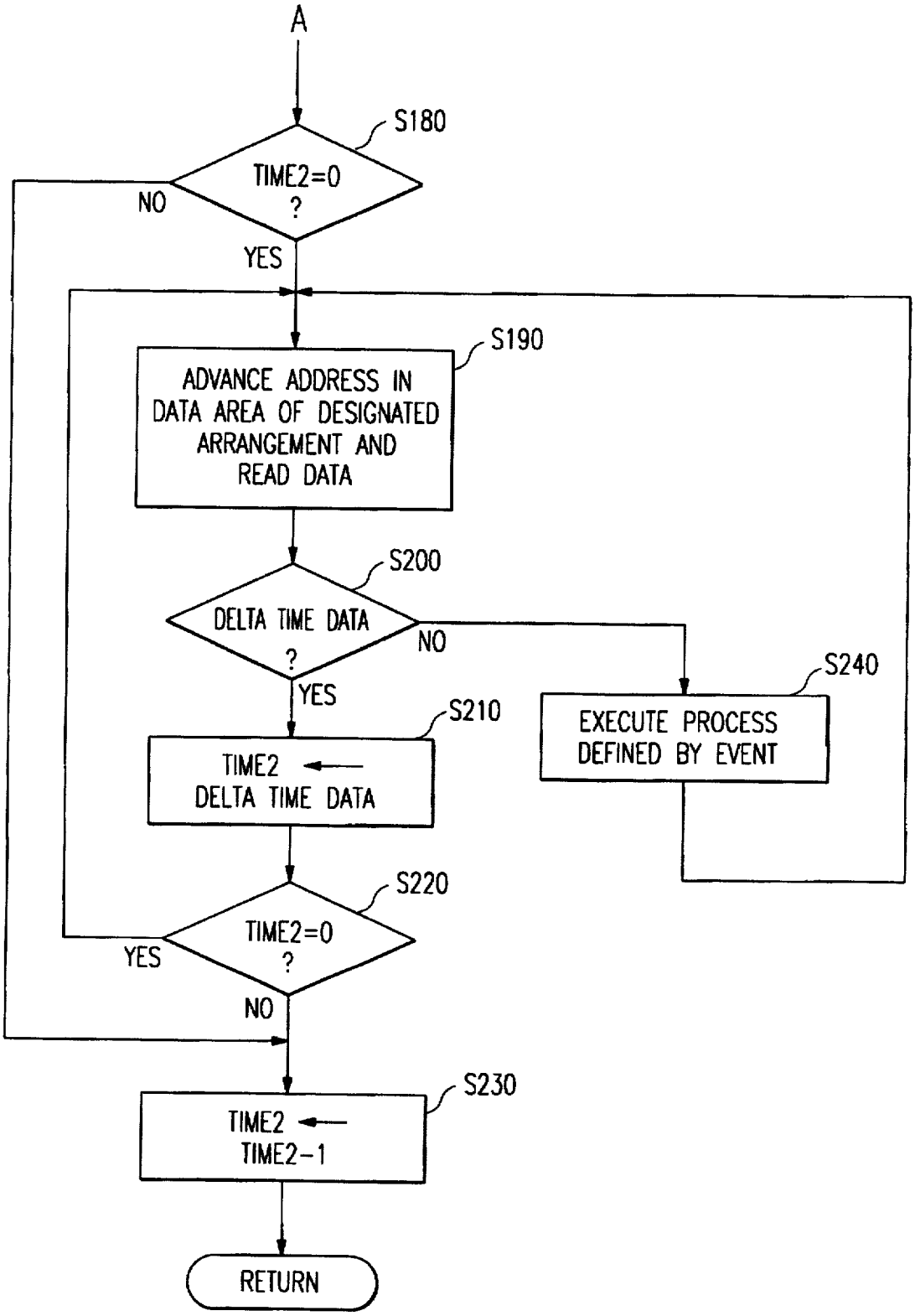

FIGS. 7 (A) and 7 (B) show a flow chart of a first reproduction process that carries out reproduction when the automatic performance is started. The first reproduction process is a reproduction process that uses the data format in accordance with the first embodiment shown in FIG. 2. The first reproduction process is staffed by a timer interruption.

When the first reproduction process is started, a determination is made as to whether the RUN flag is set at "1" in step S100. When the determination is "RUN=1" (meaning that the automatic performance is in progress), a determination is made as to whether the data in a register TIME 1 is also set to "0" in step S110. The register TIME 1 stores delta time data for the common data of the selected music piece. When the data in the register TIME 1 is "0", it means that the process has reached a timing for reading an event of the common data. Therefore, when the determination is "TIME 1=0", the address in the common data memory region is advanced to a next address by one address and the common data from that address is read out in step S120.

In the next step S130, a determination is made as to whether the data being read out is delta time data. If it is determined that the data is delta time data, the process advances to step S140, and the delta time data read out in step S120 is stored at the register TIME 1 as new data. Further, a determination is made in step S150 as to whether the data in the register TIME 1 is "0". When the determination is "TIME 1=0", the process returns to step S120, and the process in step S120 through S150 is repeated. When the determination in step S110 or step S150 is "TIME 1≠0", the process proceeds to step S160, where the data in the register TIME 1 is decremented by one. The data in the register TIME 1 is repeatedly decremented until the process reaches a timing to read another event by the first reproducing process.

When a determination in step S130 indicates that the data is not delta time data (meaning that the data is event data), the process proceeds to step S170, where a process corresponding to the event is performed. In step S170, when an event is a note event, a process such as generation of sound and muting of sound is performed. When an event is other than a note event, a process such as loudness control and pitch bend control designated by the event is executed. When an event is end data, the automatic performance is ended. The process then returns to step S120, and the address is advance to a next address by one address and the common data from that address is read out.

When the determination in step S100 indicates that the RUN flag is not "1", the process returns to the main routine.

When the process in step S160 is executed, a determination is made in step S180 shown in FIG. 7 (B) as to whether the data in a register TIME 2 is "0". It is noted that the register TIME 2 stores delta time data of the arrangement data. When the data in the register TIME 2 is "0" (meaning that the process has reached a timing for reading an event of the arrangement data), the address in a region storing the designated arrangement data is advanced by one address and the arrangement data from that address is read out in step S190.

Next, a determination is made in step S200 as to whether the data read out is delta time data. When the determination is made that the data is delta time data, the delta time data read out in step S190 is stored in the register TIME 2 as new data in step S210.

A determination is then made in step S220 as to whether the data in the register TIME 2 is "0". When the determination is "TIME 2=0", the process returns to step S190, and the process from step S190 through step S220 is repeated. On the other hand, when the determination is step S220 is not "TIME2=0", the process proceeds to step S230 where the data in the register TIME 2 is decremented by one, and returns to the main routine.

When the determination in step S180 indicates that the data in the register TIME 2 is not "0", the process proceeds to step S230 in which the data in the register TIME 2 is decremented by one, and returns to the main routine. The data in the register TIME 2 is repeatedly decremented until the process reaches a timing to read an event by the first reproducing process.

When the determination in step S200 indicates that the data read out is not delta time data (meaning that the data is event data), the process proceeds to step S240 where a process corresponding to an event representative of the event data is performed, and the process then returns to step S190 where the address in the memory region storing the designated arrangement data is advanced by one address and arrangement data in that address is read out.

It is noted that, in step S240, when the event is a note event, a process such as generation of a sound or muting of a sound is performed. When an event is other than a note event, a process such as loudness control and pitch bend control designated by the event is executed. When an event is end data, the automatic performance is ended.

The first reproduction process is performed in a manner described above. Since common data and arrangement data are stored in different memory regions, the data in the register TIME 1 is set with the delta time data for the common data that determines the timing for reading the common data, and the data in the register TIME 2 is set with the delta time data for the arrangement data that determines the timing to read the arrangement data.

It is noted that the timer interruption timing for performing the first reproducing process is determined by the cycle of the timer 2 (see FIG. 1 ). Therefore, by controlling the cycle of the timer 2 using tempo data, the cycle or tempo for reading the automatic performance data is set.

Figure 8:
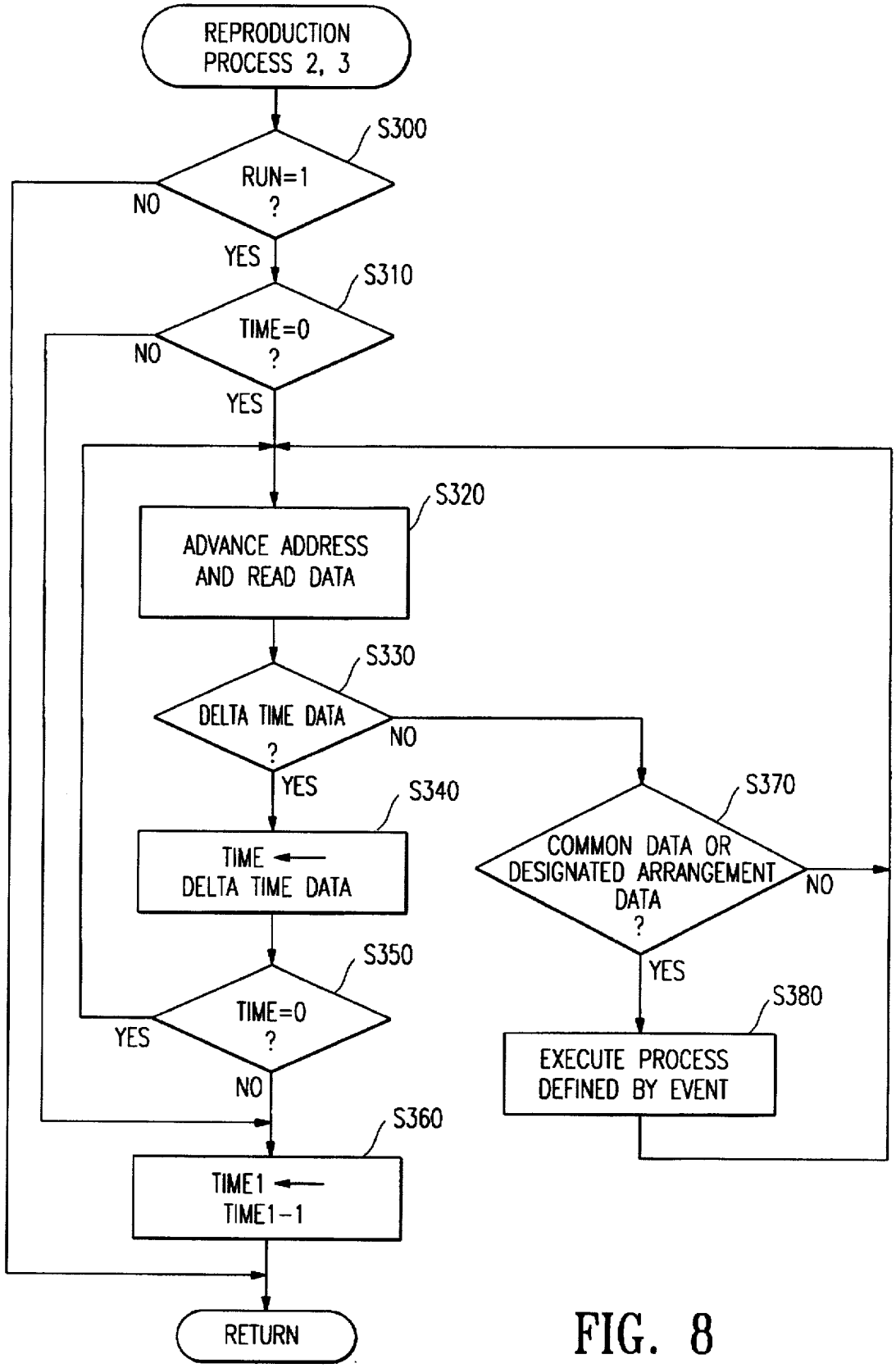
FIG. 8 shows a flow chart of a second and of a third reproducing process using the second and third data format embodiments, respectively.

FIG. 8 shows a flow chart of a second reproduction process for the data format shown in FIG. 3, and a third reproducing process for the data format shown in FIG. 4. The second and third reproducing process is started by a timer interruption from the timer 2.

When the second and third reproducing process is started, a determination is made in step S300 as to whether a RUN flag is "1". When the determination is "RUN=1", there is an occasion in which the automatic performance is being performed, and therefore a determination is made in step S310 as to whether the data in the register TIME is "0". When the data in the register TIME is "0", it means that the process has reached a timing to read an event. Accordingly, when the determination is "TIME=0" the address is advanced to a next address by one address and data from that address is read out in step S320.

A determination is then made in step S330 as to whether the data read out is delta time data. When the determination in step S330 indicates that the data read out is delta time data, the delta time data is stored in the register TIME as new data in step S340: Further, a determination is made in step S350 as to whether the data in the register TIME is "0". When the determination is "TIME=0", the process returns to step S320, and the process from step S320 through step S350 is repeated.

When a determination in step S310 or step S350 indicates that the data in the register TIME is not "0", the process proceeds to step S360 where the data in the register TIME is decremented by one, and returns to the main routine. The data in the register TIME is repeatedly decremented until the process reaches a timing to read an event by the second and third reproducing process.

When the determination in step S330 indicate that the data read out is not delta time data, the process diverges to step S370. In step S370, a determination is made as to whether the data is either common data or designated arrangement data. When the determination indicates that the data is either common data or designated arrangement data, the process proceeds to step S380 where a process corresponding to an event representative of either the common data or the designated arrangement data is executed. Then, the process returns to step S320, and the address is advanced to a next address by one address and the next data is read out from that address. When the determination in step S370 does not indicate that the data is either common data or designated arrangement data, the process returns to step S320.

It is noted that, in step S380, a process corresponding to an event is executed in a similar manner to the process that is executed in step S170 or step S240, as described above.

When the determination in step S300 indicate that the RUN flag is not "1", the process returns to the main routine.

As described above, in step S370, the second and third reproducing process reads only data relating to the selected arrangement in order to perform the automatic performance, and does not select data that is not required. For data in the format of the second embodiment shown in FIG. 3, selected data is recognized by arrangement numbers. For data in the format of the third embodiment shown in FIG. 3, selected data is recognized by the channel numbers.

Also, an arrangement designation switch may be manipulated during the automatic performance to change the selected arrangement number or the selected channel number. As a result, the arrangement can be changed during the automatic performance. In such a case, a part of the music piece that uses the common data, for example, a melody part is continuously performed.

Figure 9A:
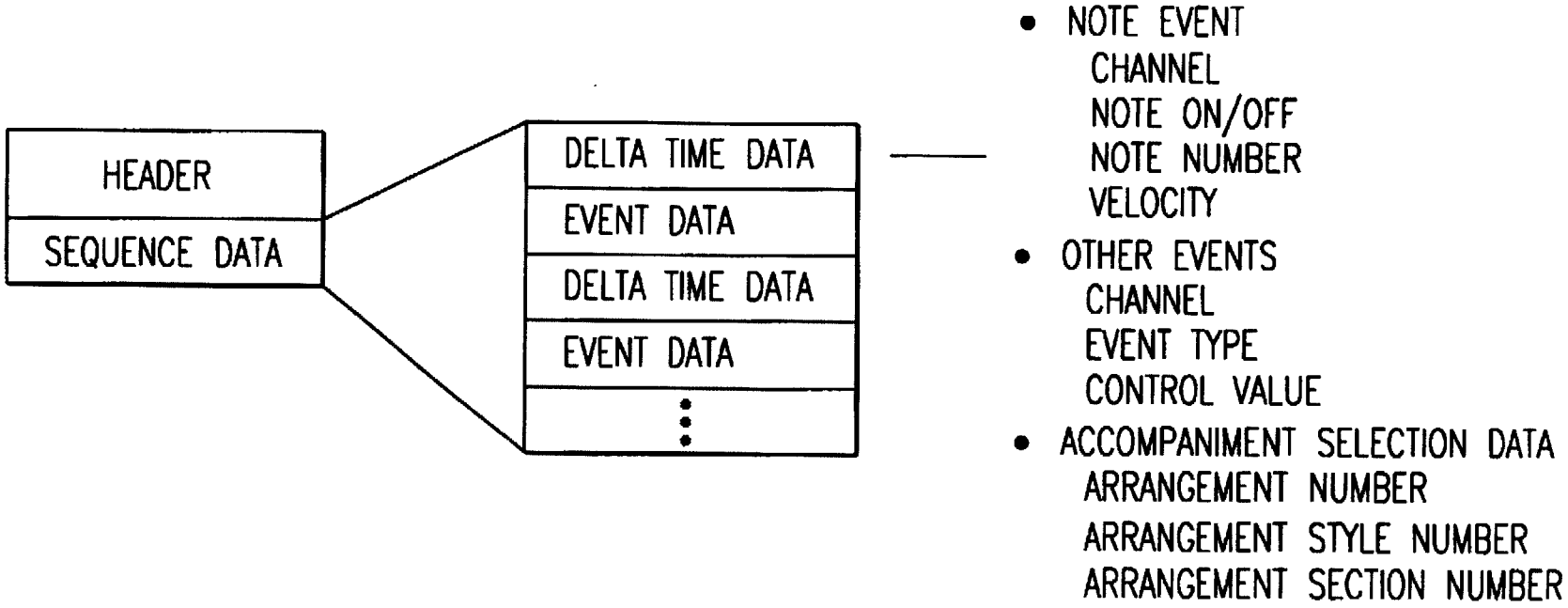
FIGS. 9 (A) and (B) show data format in accordance with a fourth embodiment of the present invention.
Figure 9B:
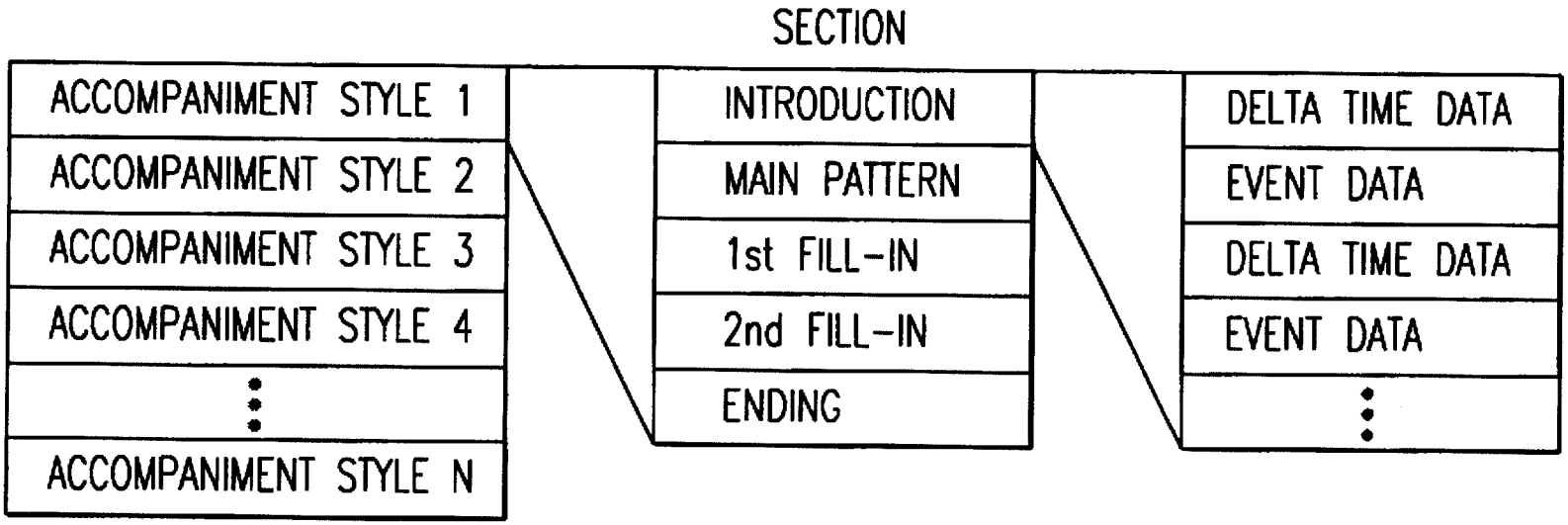

Next, a data format in accordance with a fourth embodiment of the present invention is shown in FIGS. 9 (A) and (B). This data format includes sequence data that has data for selecting an accompaniment pattern. In a preferred embodiment, a plurality of accompaniment pattern selection data is stored. Each accompaniment pattern selection data is associated with each arrangement, and an accompaniment pattern is selected based upon selecting a desired arrangement.

Sequence data is formed from delta time data and event data as shown in FIG. 9 (*a*). Event data includes note event data, other event data and accompaniment pattern selection data. The note event data includes, for example, channel number data, note-on/note-off data, note number data, velocity data and the like. The other event data includes, for example, event type data, such as, channel number data, loudness data, pitch bend data and pedal data and control data that is determined by the event type. The accompaniment pattern selection data includes arrangement number data, accompaniment style number data, and accompaniment section number data.

Also, as shown in FIG. 9(*b*), accompaniment pattern data is formed from a plurality of accompaniment style data. Each of the accompaniment style data includes five data sections, namely, an introduction pattern, a main pattern and a first fill-in pattern, a second fill-in pattern and an ending pattern. Further, each data section includes delta time data and event data. Therefore, the number of possible accompaniment patterns is defined by the multiplication of the number of accompaniment styles and the number of sections.

It is noted that, in general, the accompaniment pattern data is prestored in the ROM 3. However, by using the keyboard 8 or the switch 10, data can be formed by a user and stored in a RAM 4, so that the data may be supplied as the accompaniment pattern data. Alternatively, the accompaniment pattern data can be supplied through the floppy disc drive 6, the MIDI I/F 5 or through the communication I/F 7.

Figure 10:
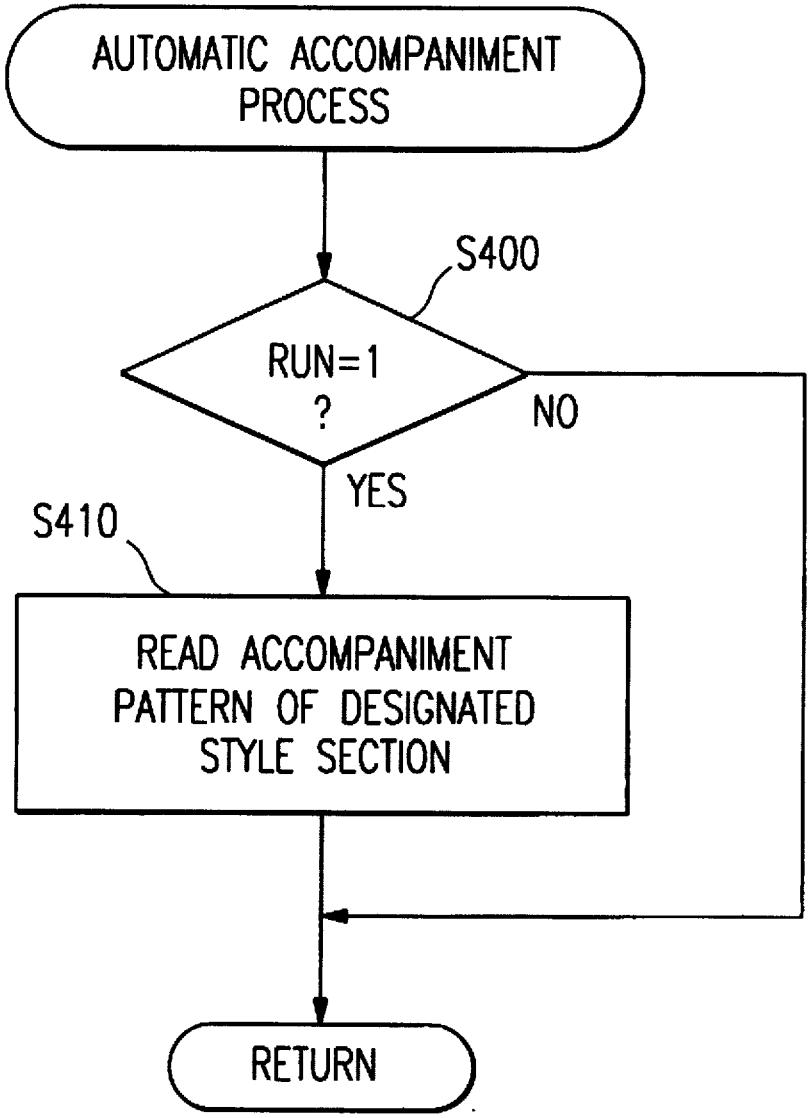
FIG. 10 shows a flow chart of an automatic accompaniment process using the fourth data format embodiment.

Next, FIG. 10 shows a flow chart of an automatic performance process where the automatic accompaniment is performed based on the accompaniment pattern data. The automatic accompaniment process is started by a timer interruption.

When automatic accompaniment process is started, a determination is made in step S400 as to whether a RUN flag is "1". When the RUN flag is "1" (meaning that the process is in an automatic performance), the process proceeds to step S410 in which an address pointer is shifted to an address where an accompaniment pattern determined by a designated style number and a section number is stored, and accompaniment pattern data corresponding to the designated arrangement is read out. Then the process returns to the main routine.

When the determination in step S400 indicates that the RUN flag is not "1" (meaning that automatic performance is not in progress), the process returns to the main routine.

Figure 11:
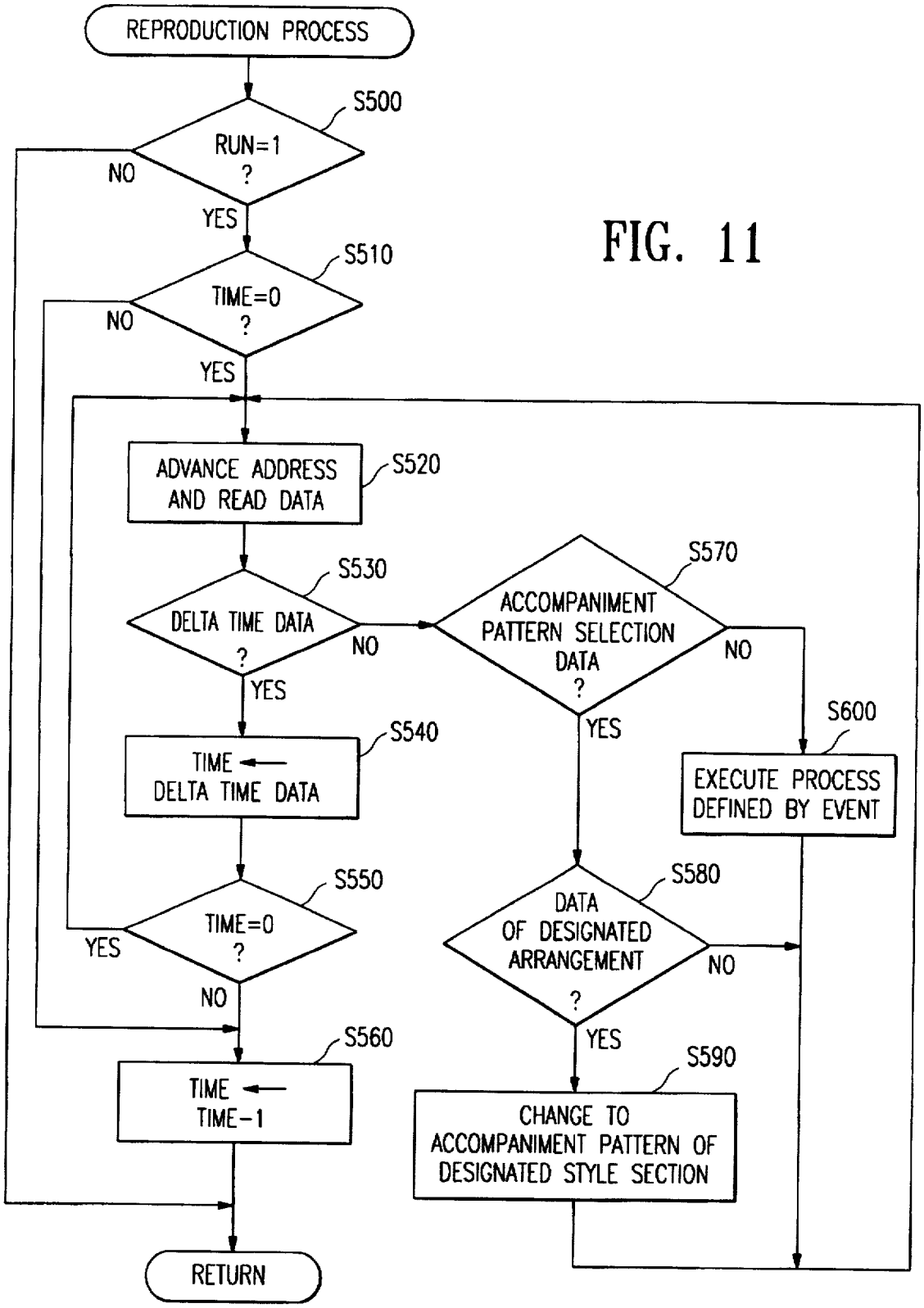
FIG. 11 shows a flow chart of a reproducing process using the fourth data format embodiment.

FIG. 11 shows a flow chart of a reproduction process when the data format is in accordance with the embodiment shown in FIG. 9. This reproduction process is also started by a timer interruption.

When the reproduction process is started, a determination is made in step S500 as to whether a RUN flag is "1". When the determination indicates "RUN=1", there is an occasion in which automatic performance is in progress, and therefore a determination is made in step S510 as to whether data in a register TIME is "0". When the data in the register TIME is "0", the process has reached a timing to read out an event, and the address is advance to a next address by one address and data in that address is read out in step S520.

Next, a determination is made in step S530 as to whether the read out data is delta time data. When the determination indicates that the read data is delta time data, the read out delta time data is stored in the register TIME as new data in step S540. Further, a determination is made in step S550 as to whether the data in the register TIME is "0". When the determination indicates "TIME=0", the process returns to step 520, and the process from step S520 through step S550 is repeated.

When the determination in step S530 indicate that the data is not delta time data, the process proceeds to step S570. In step S570, a determination is made as to whether the read out data is accompaniment pattern selection data. When the determination indicates that the read out data is accompaniment pattern selection data, the process proceeds to step S580 in which a determination is made as to whether the read out data is data relating to a designated arrangement (i.e., designated arrangement data). When the determination indicates that the read out data is the designated arrangement data, the accompaniment pattern is changed to one that is determined by the designated arrangement data and the section data. Then the process returns to step S520. When the determination indicates that the read out data is not the designated arrangement data, the data is not required and thus is rejected, and the process then returns to step S520.

When the process returns to step S520, the address is advance to a next address by one address and the next data in that address is read out. Then the process described above is repeated.

When the determination in step S570 indicates that the read out data is not accompaniment pattern selection data, a process defined by an event is executed in step S600, and then the process returns to step S520. The process to be executed in step S600 includes a process of generating a sound, muting a sound or the like when the event is a note event, and a process for controlling loudness, pitch bend or the like when the event is other than a note event. When the event is an end data, the automatic performance is ended.

When the determination in step S500 indicate that the RUN flag is not "1" (meaning that an automatic performance is not in progress), and the process returns to the main routine.

In the manner described above, an automatic performance is carried out when the data format in accordance with the embodiment shown in FIG. 9 is used. FIGS. 12 (A), 12 (B) and 12 (C) show different accompaniment patterns used in response to different arrangements for data in accordance with the embodiment shown in FIG. 9 (B).

FIGS. 12 (A), 12 (B) and 12 (C) show accompaniment patterns for a first arrangement, a second arrangement, and a third arrangement, respectively, in which performance over a lapse of time t is taken along a horizontal axis. In the first arrangement, an introduction pattern (1-I) of a first accompaniment style is started at time t0, a main pattern (1-M) of the first accompaniment style is started at time t1 and continues until time t8. The main pattern is changed to a first fill-in (1- F1 ) of the first accompaniment style at time t8, and then it is returned to the main pattern (1- M) at time t9. The main pattern is continued until time tl 1, and is changed to an ending pattern (1- E) of the first accompaniment style at time t11. The ending pattern ends at time t12.

In the second arrangement, an introduction pattern (2-I) of a second accompaniment style is started at time t0, a main pattern (4- M) of a fourth accompaniment style is started at time t3. The main pattern is changed to a second fill-in (5-F2) of a firth accompaniment style at time t5. Further, the second fill-in is changed to the main pattern of the fifth accompaniment style (5- M) at time t7. This main accompaniment pattern (5- M) continues until time t10. The main accompaniment pattern is changed to an ending (2- E) of the second accompaniment style at time tl 0. The ending ends at time t12.

In the third arrangement, an introduction pattern (3-I) of a third accompaniment style is started at time t0, a main pattern (3- M) of the third accompaniment style is started at time t2. The main pattern is changed to a second fill-in (3-F2) of the third accompaniment style at time t4. Further, it is changed back to the main pattern (3- M) of the third accompaniment style at time t6. This main accompaniment pattern continues until time t12, and ends at time t12

FIG. 12 shows an embodiment with three arrangements. However, the present invention is not limited to this number.

In alternative embodiments of the invention, some of the plural arrangements may be randomly selected. In this case, a random pattern may be changed for each individual automatic performance.

Further, embodiments of the present invention are applicable to karaoke (sing-along) systems as well as electronic musical systems. When applied to a karaoke system that is capable of showing a background image on a display device, the background image may preferably be selected depending on a selected arrangement. Moreover, sounds of a back chorus may be separately added depending on a particular arrangement selected. In particular arrangements, this data may be included in the header portion.

For an automatic performance, a part in the sequence data may be muted. In particular embodiments, parts to be muted may be arranged so that muted parts change in response to a selected accompaniment pattern.

Furthermore, the accompaniment pattern selection data may be included in the sequence data, or the accompaniment pattern selection data may be stored separately from the sequence data.

As described above, in accordance with embodiments of the present invention, a plurality of arrangement performance data is stored for an automatic performance of one music piece, and upon selection of an arrangement, selected arrangement performance data is extracted for automatically performing the piece of music. As a result, the music piece is automatically performed with a plurality of different arrangements. Also these data formats only require one file that stores all of the automatic performance data. Consequently, data management for the automatic performance of a music piece is easier as compared with conventional systems in which automatic performance data is individually stored for each separate arrangement.

Furthermore, the automatic performance data includes the common automatic performance data that is commonly used by different arrangements. As a result, the amount of stored automatic performance data is reduced. Also, using common data permits the arrangement to be changed without changing, for example, a main melody, during the automatic performance. For example, a music piece can be changed from a rock 'n roll style to a pops style while the music melody is being played. Accordingly, the automatic performance can be performed with a variety of musical patterns with different.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An automatic performance apparatus comprising:

a memory device that stores at least one music piece, wherein the at least one music piece includes a plurality of automatic performance data corresponding to a plurality of different arrangements and common automatic performance data being commonly used for all of the plurality of different arrangements;

a selection device that selects an arrangement from the plurality of different arrangements; and a control device that simultaneously reads out the common automatic performance data and one of the plurality of automatic performance data corresponding to the selected one of the plurality of different arrangements to perform an automatic performance.

2. An automatic performance apparatus as defined in claim 1, wherein the memory device includes a plurality of memory regions, each of the memory regions being for individually storing each of the plurality of automatic performance data and the common data.

3. An automatic performance apparatus as defined in claim 1, wherein the memory device includes a plurality of memory regions, each of the memory regions being for individually storing each of the plurality of automatic performance data corresponding to the plurality of different arrangements, and wherein the automatic performance data corresponding to the selected one of the plurality of different arrangements is read from an associated one of the plurality of memory regions that stores the automatic performance data corresponding to the selected arrangement.

4. An automatic performance apparatus comprising:

a memory device that stores a plurality of automatic performance data of a music piece, the plurality of automatic performance data corresponding to a plurality of different arrangements, wherein the plurality of automatic performance data includes common data that is commonly used for all of the plurality of different arrangements for the automatic performance; and a selection device that selects an arrangement from the plurality of different arrangements;

wherein one of the plurality of automatic performance data corresponding to the selected one of the plurality of different arrangements is read out from the memory device to perform an automatic performance, wherein the memory device stores the plurality of automatic performance data including the common data corresponding to the plurality of different arrangements in an intermixed state, and each of the plurality of automatic performance data including the common data includes identification data to identify each of the plurality of different arrangements, and wherein one of the identification data associated with the selected one of the plurality of different arrangements is detected to extract one of the plurality of automatic performance data corresponding to the selected one of the plurality of different arrangements from the memory device to perform the automatic performance.

5. An automatic performance apparatus as defined in claim 4, wherein an identification data indicative of the selected one of the plurality of different arrangements is changed to a different identification data indicative of a different arrangement to change the selected one of the plurality of arrangements to the different arrangement while the automatic performance data is continuously extracted to perform the automatic performance.

6. An automatic performance apparatus comprising:

a memory device that stores a plurality of automatic performance data of a music piece, the plurality of automatic performance data corresponding to a plurality of different arrangements, wherein the plurality of automatic performance data includes common data that is commonly used for all of the plurality of different arrangements for the automatic performance; and a selection device that selects an arrangement from the plurality of different arrangements;

wherein one of the plurality of automatic performance data corresponding to the selected one of the plurality of different arrangements is read out from the memory device to perform an automatic performance, wherein the plurality of automatic performance data includes a plurality of channels, and wherein each of the plurality of different arrangements is defined by at least one channel.

7. An automatic performance apparatus as defined in claim 6, wherein each of the plurality of different arrangements is determined by a combination of channels selected from the plurality of channels.

8. An automatic performance apparatus as defined in claim 6, wherein a channel indicative of the selected one of the plurality of different arrangements is changed to a different channel indicative of a different arrangement while the automatic performance data is continuously extracted to perform the automatic performance.

9. An automatic performance apparatus comprising:

a memory device that stores a plurality of automatic performance data of a music piece, the plurality of automatic performance data corresponding to a plurality of different arrangements; and a selection device that selects an arrangement from the plurality of different arrangements;

wherein one of the plurality of automatic performance data corresponding to the selected one of the plurality of different arrangements is read out from the memory device to perform an automatic performance, wherein the memory device stores the plurality of automatic performance data in an intermixed state, and each of the plurality of automatic performance data includes identification data to identify each of the plurality of different arrangements, and wherein an identification data associated with the selected one of the plurality of arrangements is detected to extract the automatic performance data corresponding to the selected arrangement from the memory device to perform the automatic performance.

10. An automatic performance apparatus comprising:

a memory device that stores a plurality of automatic performance data of a music piece, the plurality of automatic performance data corresponding to a plurality of different arrangements; and a selection device that selects an arrangement from the plurality of different arrangements;

wherein one of the plurality of automatic performance data corresponding to the selected one of the plurality of different arrangements is read out from the memory device to perform an automatic performance, wherein the memory device stores initial setting data for each of the plurality of different arrangements, and wherein a performance environment of the selected arrangement is set based on the initial setting data corresponding to the selected arrangement.

11. A method of automatically performing a music, the method comprising the steps of:

storing data of a music piece, the data of the music piece including a plurality of accompaniment data, a plurality of automatic performance data corresponding to a plurality of arrangements, and a plurality of accompaniment selection data corresponding to the plurality of accompaniment data and associated with the plurality of arrangements;

selecting one of the plurality of arrangements;

reading one of the plurality of automatic performance data corresponding to the selected one of the plurality of arrangements and performing an automatic performance based on the one of the plurality of automatic performance data read out;

extracting one of the accompaniment selection data associated with the selected one of the plurality of arrangements as the automatic performance of the music piece proceeds;

selecting one of the plurality of accompaniment data associated with the extracted accompaniment selection data; and automatically performing the music piece based on the selected one of the plurality of automatic performance data and the selected one of the accompaniment data.

12. A method of automatically performing a music piece, the method comprising the steps of:

storing at least one music piece, wherein each of the at least one music piece includes a plurality of automatic performance data corresponding to a plurality of different arrangements and common automatic performance data being commonly used for all of the plurality of different arrangements;

selecting one of the plurality of different arrangements;

simultaneously reading out the common automatic performance data and one of the plurality of automatic performance data corresponding to the selected one of the plurality of different arrangements; and performing an automatic performance based on the read out common automatic performance data and the one of the plurality of automatic performance data.

13. A method of automatically performing a music piece as defined in claim 12, wherein the memory device includes a plurality of memory regions for individually storing each of the plurality of automatic performance data in each associated one of the memory regions, the method further including the step of reading the one of the plurality of automatic performance data corresponding to the selected one of the plurality of different arrangements from an associated one of the plurality of memory regions.

14. A method of automatically performing a music piece as defined in claim 12, wherein the memory device stores the plurality of automatic performance data including the common data in an intermixed state, and each of the plurality of automatic performance data and the common data includes identification data to identify each of the plurality of different arrangements, and wherein the method further includes the step of detecting one of the identification data associated with the selected one of the plurality of different arrangements to extract the one of the plurality of automatic performance data corresponding to the selected one of the plurality of different arrangements from the memory device to perform the automatic performance.

15. A method of automatically performing a music piece, the method comprising the steps of:

storing a plurality of automatic performance data of a music piece in a memory device, the plurality of automatic performance data corresponding to a plurality of different arrangements, wherein the plurality of automatic performance data includes common data that is commonly used for all of the plurality of different arrangements for the automatic performance;

selecting one of the plurality of different arrangements;

reading one of the plurality of automatic performance data corresponding to the selected one of the plurality of different arrangements;

performing an automatic performance based on the one of the plurality of automatic performance data read out, wherein the memory device stores the plurality of automatic performance data including the common data in an intermixed state, and each of the plurality of automatic performance data and the common data includes identification data to identify each of the plurality of different arrangements; and detecting one of the identification data associated with the selected one of the plurality of different arrangements to extract the one of the plurality of automatic performance data corresponding to the selected one of the plurality of different arrangements from the memory device to perform the automatic performance.

16. A method of automatically performing a music piece as defined in claim 15, further including the step of changing an identification data indicative of the selected arrangement to a different identification data indicative of a different arrangement to change the selected arrangement to the different arrangement while the automatic performance data is continuously extracted to perform the automatic performance.

17. A method of automatically performing a music piece, the method comprising the steps of:

storing a plurality of automatic performance data of a music piece in a memory device, the plurality of automatic performance data corresponding to a plurality of different arrangements, wherein the plurality of automatic performance data includes common data that is commonly used for all of the plurality of different arrangements for the automatic performance;

selecting one of the plurality of different arrangements;

reading one of the plurality of automatic performance data corresponding to the selected one oft he plurality of different arrangements; and performing an automatic performance based on the one of the plurality of automatic performance data read out, wherein the automatic performance data includes a plurality of channels, and wherein each of the plurality of different arrangements is defined by at least a channel.

18. A method of automatically performing a music piece as defined in claim 17, wherein each of the plurality of different arrangements is determined by a combination of channels selected from the plurality of the channels.

19. A method of automatically performing a music piece as defined in claim 17, further including the step of changing a channel indicative of the selected arrangement to a different channel indicative of a different arrangement while the automatic performance data is continuously extracted to perform the automatic performance.

20. A method of automatically performing a music, the method comprising the steps of:

storing a plurality of automatic performance data of a music piece in a memory device, the plurality of automatic performance data corresponding to a plurality of different arrangements;

selecting one of the plurality of different arrangements;

reading one of the plurality of automatic performance data corresponding to the selected one of the plurality of different arrangements;

performing an automatic performance based on the one of the plurality of automatic performance data read out; and storing initial setting data associated with each of the plurality of different arrangements in the memory device, and setting a performance environment of the selected of the plurality of different arrangements based on the initial setting data corresponding to the selected arrangement.

21. A method of automatically performing a music piece, the method comprising the steps of:

storing a plurality of automatic performance data of a music piece in a memory device, the plurality of automatic performance data corresponding to a plurality of different arrangements;

selecting one of the plurality of different arrangements;

reading one of the plurality of automatic performance data corresponding to the selected one of the plurality of different arrangements;

performing an automatic performance based on the one of the plurality of automatic performance data read out;

storing a plurality of accompaniment data, and a plurality of accompaniment selection data corresponding to the plurality of accompaniment data and associated with the plurality of different arrangements;

extracting one of the accompaniment selection data associated with the selected one of the plurality of different arrangements as the automatic performance of the music piece proceeds;

selecting one of the plurality of accompaniment data associated with the extracted one of the plurality of accompaniment selection data; and automatically performing the music piece based on the selected one of the plurality of automatic performance data and the selected one of the plurality of accompaniment data.

* * * * *